United States Patent [19]

Newton

[11] 4,425,499

[45] Jan. 10, 1984

[54] DECISION TREE GRAPHICAL COMPUTER

[75] Inventor: Roger A. Newton, Brookfield, Wis.

[73] Assignee: Wisconsin Electric Power Co., Milwaukee, Wis.

[21] Appl. No.: 421,783

[22] Filed: Sep. 23, 1982

[51] Int. Cl.[3] ..... G06C 3/00

[52] U.S. Cl. ..... 235/70 R; 235/89 R; 235/70 A

[58] Field of Search ..... 235/69, 70 R, 70 A, 235/85 R, 89 R; 434/181, 322; 116/323, 335

[56] References Cited

U.S. PATENT DOCUMENTS

| | | | |
|---|---|---|---|
| 3,005,586 | 10/1961 | Stevenson | 235/89 R |
| 3,034,708 | 5/1962 | Bean, Jr. | 235/61 B |
| 3,166,672 | 1/1965 | Gardner | 455/600 |
| 3,411,223 | 11/1968 | Vinci | 434/181 |
| 3,650,467 | 3/1972 | Sellie | 235/89 R |
| 3,704,533 | 12/1972 | Weber | 434/181 |

OTHER PUBLICATIONS

Quadrex Corporation, "SAS Functional Design Specification Document", pp. IV-21 to IV-25.

Magee "Decision Trees for Decision Making" *Harvard Business Review,* Jul.-Aug., 1964.

*Primary Examiner*—Benjamin R. Fuller

*Attorney, Agent, or Firm*—Quarles & Brady

[57] ABSTRACT

A graphical logic computer is formed by apertured parameter slides that are moved back and forth in an envelope between an apertured cover member and a back panel. The cover member has an event network with paths that branch from and connect event windows formed by the apertures in the cover member. Event indicators are disposed on the back panel in position to be observed through the event windows provided none of the parameter slides obstructs its view. The parameter slides have logic windows, and the position of each parameter slide with a logic window or solid portion aligned with an event window corresponds to a logical input, the combination of two or more such imputs providing a logical output. For each combination of slide positions, a single path is observed through the event network to a logically determined result.

9 Claims, 5 Drawing Figures

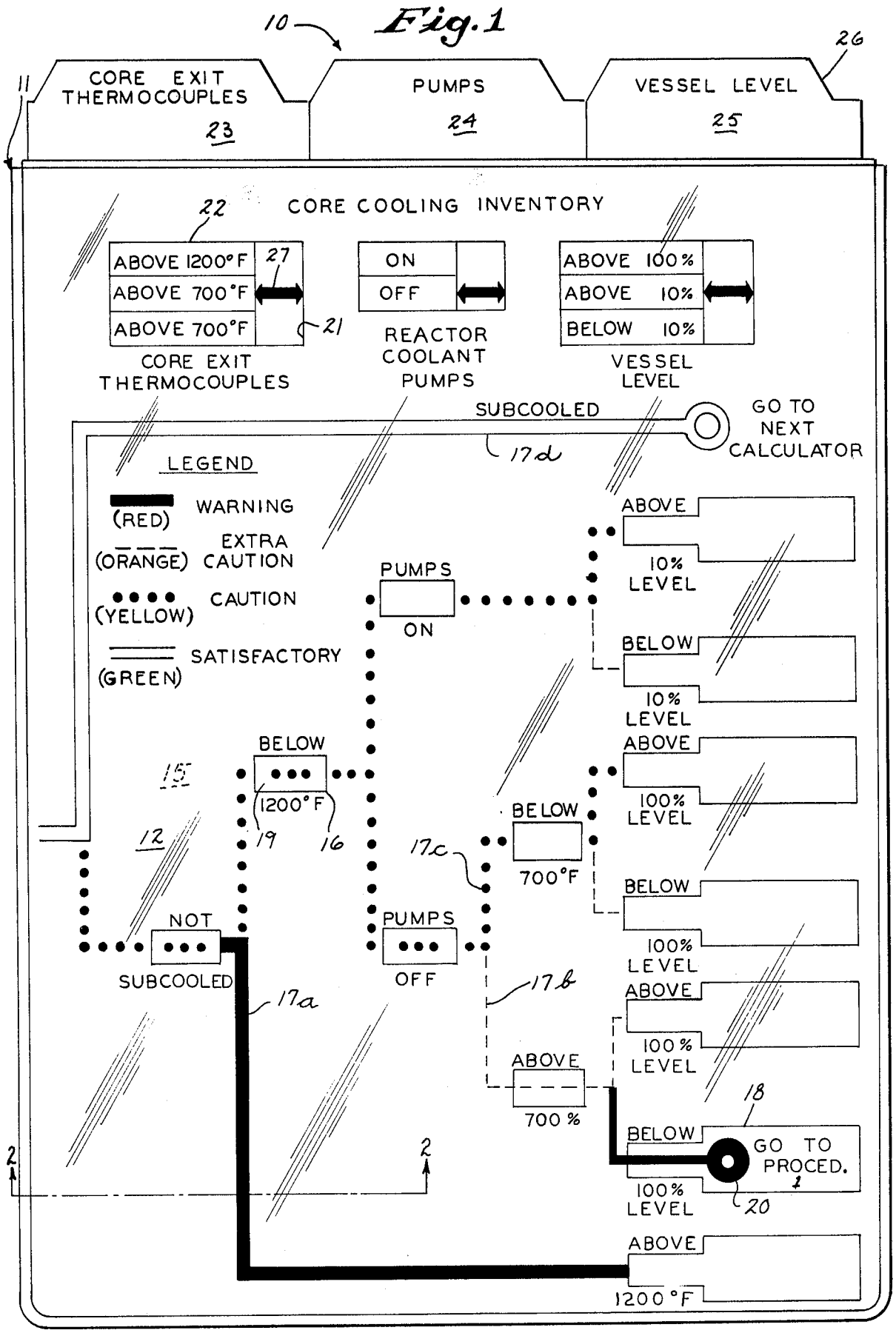
Fig. 1
10
11
26
CORE EXIT THERMOCOUPLES
23
PUMPS
24
VESSEL LEVEL
25
CORE COOLING INVENTORY
22
ABOVE 1200°F
ABOVE 700°F
ABOVE 700°F
27
21
CORE EXIT THERMOCOUPLES
ON
OFF
REACTOR COOLANT PUMPS
ABOVE 100%
ABOVE 10%
BELOW 10%
VESSEL LEVEL
SUBCOOLED
GO TO NEXT CALCULATOR
17d
LEGEND
(RED) WARNING
(ORANGE) EXTRA CAUTION
(YELLOW) CAUTION
(GREEN) SATISFACTORY
PUMPS
ON
ABOVE
10% LEVEL
BELOW
10% LEVEL
ABOVE
100% LEVEL
BELOW
1200°F
15
19
16
12
17c
BELOW
700°F
BELOW
100% LEVEL
NOT
SUBCOOLED
PUMPS
OFF
17a
17b
ABOVE
100% LEVEL
ABOVE
700%
18
BELOW
GO TO PROCED. 1
100% LEVEL
20
2
2
ABOVE
1200°F

DECISION TREE GRAPHICAL COMPUTER

BACKGROUND OF THE INVENTION

I. Field of the Invention

The field of the invention is hand-held graphical computers which assist human decision-making in monitoring and controlling industrial processes.

II. Description of the Prior Art

In monitoring and controlling nuclear plant operations instruments are used to measure various parameters in the reactor vessel, its supporting subsystems and the surrounding containment vessel. When conditions are sensed that are outside the normal operating range of various parameters, there is a need for human decision-making. One approach to assisting operating personnel has been to provide a book of charts showing various sets of conditions for multiple parameters. The possible conditions of each parameter are related in a network so that each condition for a selected parameter is located on a different path from the other condition for that same parameter. Each path also contained a set of conditions for multiple parameters that were related to a result or action to be taken and this was located at the end of each particular path. This network resembled a decision tree of the type disclosed in Magee, "Decision Trees for Decision Making", *Harvard Business Review,* July–August, 1964. A technical problem with these networks was that the operators had to trace the correct path while keeping in mind the conditions applicable to several parameters.

One approach to improving aids available to operators was the provision of a computer program which analyzed parameter conditions that were entered through a CRT terminal. The terminal displayed these events in a network along with a resulting decision or direction to employ a specific operating procedure.

This approach was relatively expensive, it required some knowledge of computer operations, and the computer equipment lacked portability. There was therefore a need for a low cost, simple and inexpensive hand-held computer to be carried by the operators.

Mechanical computers have usually been of the counting or slide rule type in which a scale placed on one member and a pointer on the other member is moved relative to this scale to select different values for a particular parameter. The value of this parameter therefore depends upon the distance moved by the pointer.

For example, Bean, Jr., U.S. Pat. No. 3,034,708, issued May 15, 1962, shows a five-layer graphical computer for use in actuarial, insurance and pension matters. As seen in FIG. 4 of Bean, this computer has top and bottom stationary layers 1 and 2, movable slide members 5 and 6, and a middle transparent stationary sheet 3. The top cover 1 and the upper slide 5 have apertures for viewing indicia on the lower members. The apertures 8, 9 and 11 in sheet 3, slide 6 and bottom cover 2 relate to the manner of sliding movable slide members 5 and 6.

The basic method of calculating is performed when pointers 20 and 21 in FIG. 3 of Bean are moved relative to scale 19 on the middle transparent layer to indicate two inputs, which are retirement age and present age. Pointers 20 and 21 are carried by the movable members 5 and 6, which also carry a window and a scale, respectively, to produce an output, which is months to retirement. One output is calculated according to the following equation:

$$(\text{Retirement Age} - \text{Present Age}) \times 12 = \text{Months to Retirement.}$$

In Bean, Jr., the position of a pointer along one scale determines the position of an index window along another scale. By moving both the index window and the second scale, a subtraction can be accomplished. The multiplication can be predetermined and reflected in the units selected for the result.

Sellie, U.S. Pat. No. 3,650,467, shows a time-motion calculator with windows in the top sheet of an envelope. Next to these windows are parameter values. When the operator positions the parameter indicator on the movable sheet beneath the parameter window next to a value, a corresponding set of results appears through a result window. The results are carried on the same card as the parameter pointer. In this device there is a one-to-one correspondence between each input and each output. There is no calculation or mathematical operation carried out by the computer. The mathematical operations have been predetermined and included in the result numbers.

SUMMARY OF THE INVENTION

The invention is incorporated in a graphical logic computer with multiple sliding members having logic windows, which when aligned, provide a true logical output by permitting observation of a visual indicator through at least two logic windows and an event window aligned with the logic windows. A graphic path connects a number of event windows for a plurality of parameters to a means for indicating a result, which is a written direction to refer to an operating procedure. The computer allows the operator to clearly view the selected parameter values in isolation, and as events related in the graphically displayed network linked to results that indicate an action to be taken.

In one specific embodiment, the computer includes front and back stationary members coupled together, the front stationary member having a plurality of parameter windows in one portion and having a set of event windows connected by graphic paths in another portion, the back stationary member having event indicator means aligned with the event windows, and the front and back stationary members also having means for displaying results at the ends of the graphic paths to relate events to results.

At least two slidable members are disposed in between the front and back stationary members, each slidable member having parameter indicator means for alignment within a respective parameter window and for movement between first and second positions in such window to select corresponding first and second conditions for its associated parameter. Each slidable member also has logic windows for alignment with selected event windows in the front stationary member to permit observation of the event indicator means for events which are connected in a graphic path to a displayed result. Each slidable member is also adapted to be interposed between the event windows and the event indicator means in a second graphic path to obscure visibility of the event indicator means leading to a different result. Thus, for the selected positions of the respective slidable members, the selected parameter conditions are displayed apart from the event network and the result.

The primary object of the invention is to provide low cost, simple and inexpensive hand-held mechanical computers to be carried by personnel monitoring industrial processes.

A more specific object of the invention is to provide such a device for operating personnel in a nuclear power generation plant.

A more specific object of the invention is to provide a device in which parameters are shown both in isolation and in a decision tree network that relates various conditions for the parameters to a logical result.

Another specific object of the invention is to provide a mechanical logic calculator in which selected conditions or values for the parameters are not single values but a limit on a range of values. The computer assists its human operator in distinguishing the type of event as indicated by conditions within the indicated range.

These and other objects and advantages of the invention will be apparent from the following description in which reference is made to the drawings that form part of the disclosure of the illustrative examples of the invention. The examples should not be construed as the only embodiments, however, as other embodiments that also use the principles of the invention may be within the scope of the claims following the detailed description.

BRIEF DESCRIPTION OF THE DRAWINGS

FIG. 1 is a frontal view of a graphical logic computer as it relates parameter input conditions to a graphical event network that includes displayed events connected in paths to logically determined results;

and

Figure 4:
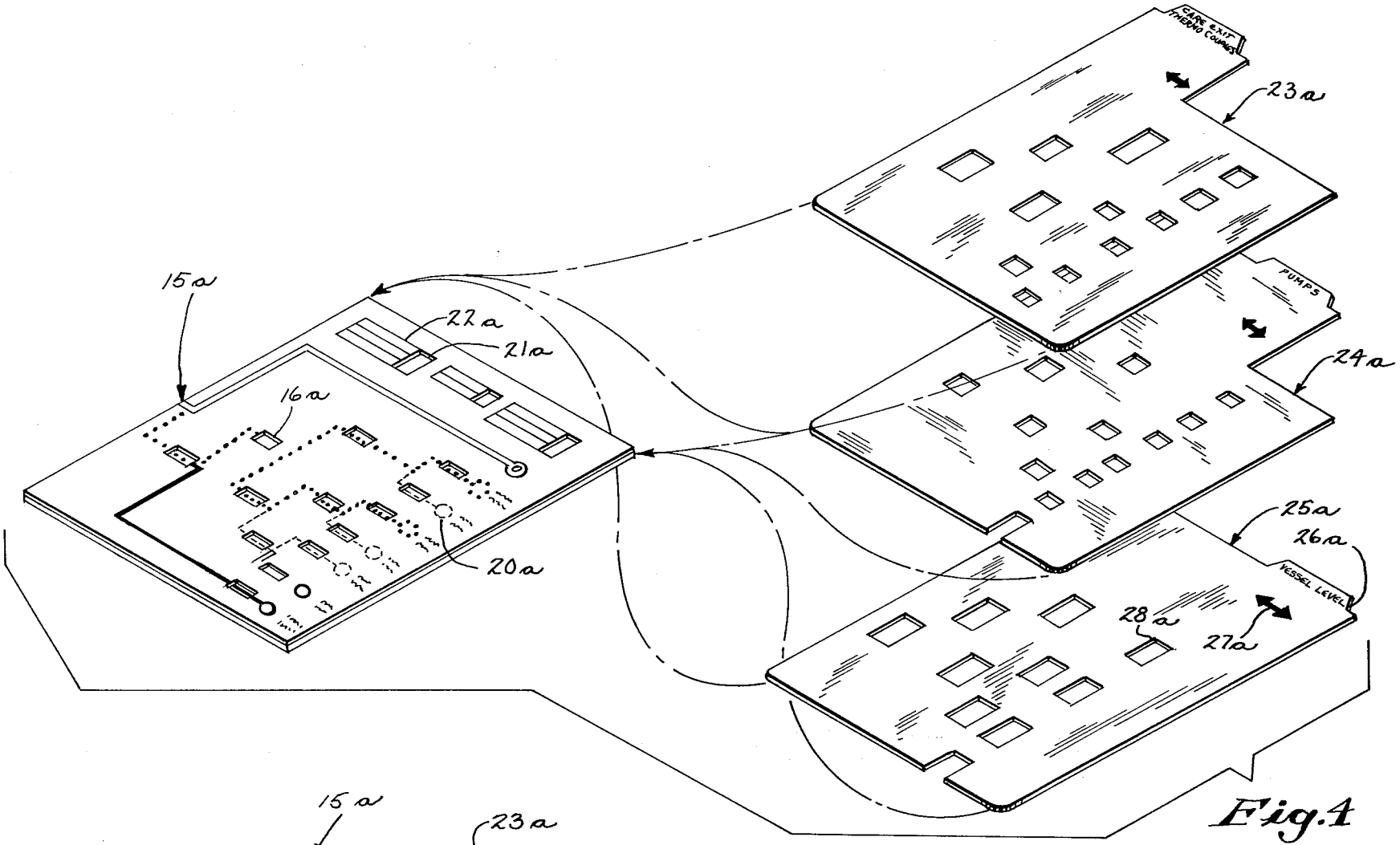
FIG. 4 is a perspective exploded view of a second embodiment of the graphical logic computer of the invention.
Figure 5:
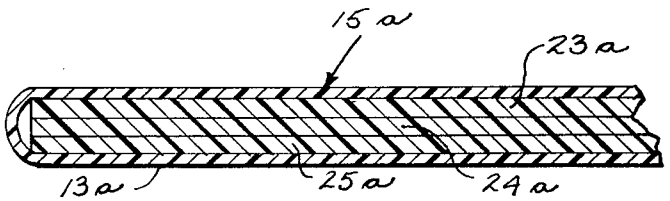

FIG. 5 is a sectional view taken in the plane indicated by line 5—5 in FIG. 4.

DETAILED DESCRIPTION OF THE PREFERRED EMBODIMENTS

Figure 3:
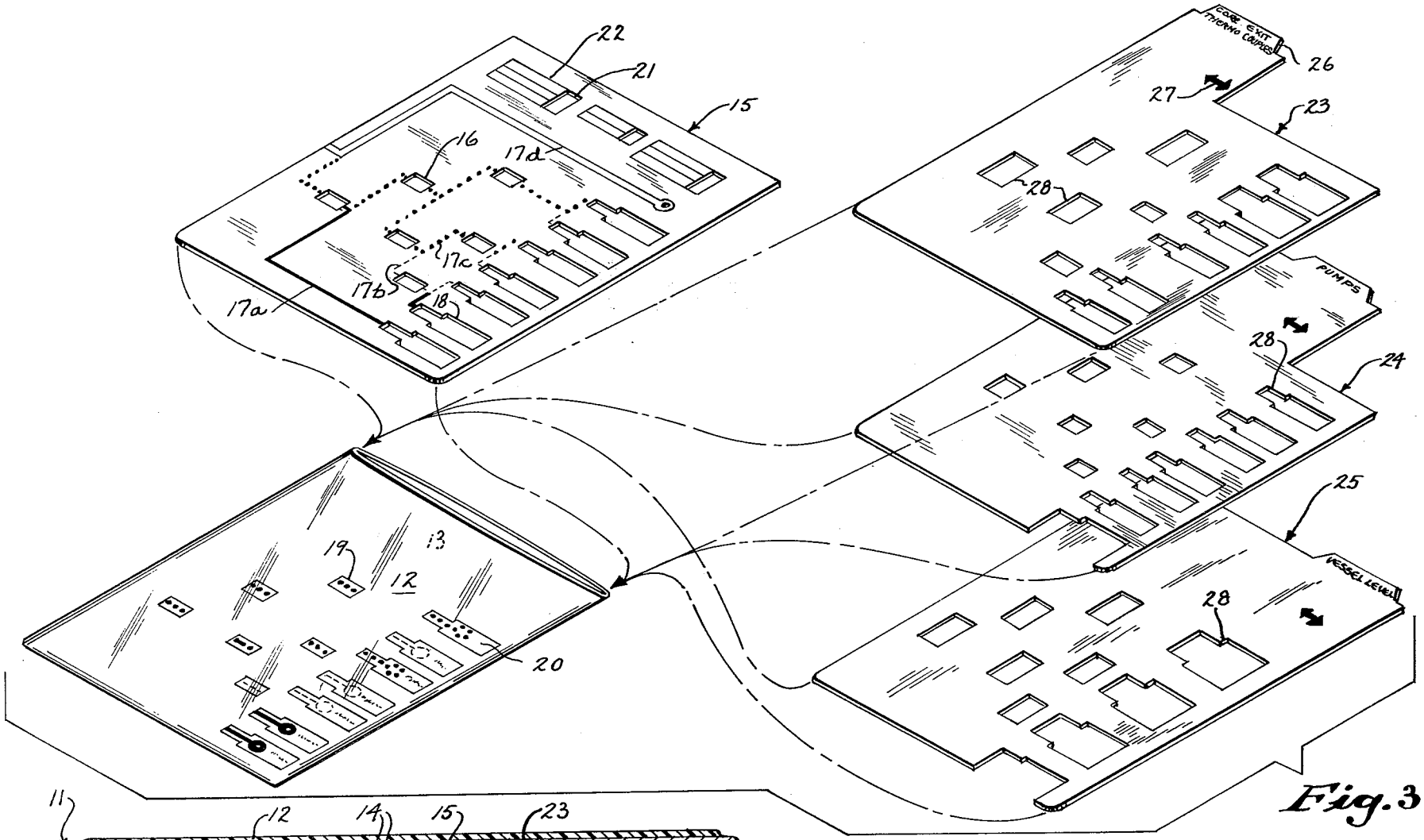
FIG. 3 is a perspective, exploded view of the graphical logic computer of FIG. 1.
Figure 2:
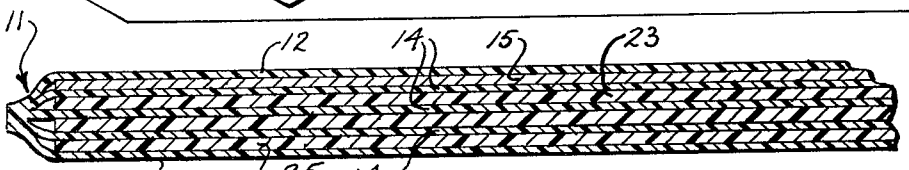
FIG. 2 is a sectional view taken in the plane indicated by line 2—2 in FIG. 1.

The graphical logic computer 10 of the present invention is seen assembled in a plastic envelope 11 in FIG. 1 and disassembled in FIG. 3. As seen best in FIG. 2, the envelope 11 has a clear, transparent front panel 12 which is joined to an opaque back panel 13 that carries color-coded, printed matter. A plurality of clear transparent dividers 14 of similar material to the front panel 12 are interposed between the front and back panels 12 and 13 to form pockets in the envelope 11. A front cover sheet 15 is slidably deposited in the frontmost pocket formed by the front panel 12 and the first divider 14. The cover sheet 15 remains in a stationary position during operation of the computer 10. This cover sheet 15 has a decision network formed by four types of colored, printed paths **17*a*–17*d* that connect thirteen windows 16 and 18. There is a path or branch 17*a*–17*d* to a first event window 16 and then a further path connecting each event window 16 to a window further to the right until the path terminates at a event-decision window 18 in the tier of windows at the far right side of the cover sheet 15**.

Referring to the legend in FIG. 1, the solid paths **17*a* are colored red, the dashed paths 17*b* are colored orange, the dotted paths 17*c* are colored yellow and the hollow line paths 17*d* are colored green. Besides being colored, these paths 17*a*–17*d* can actually be formed in these patterns, solid, dashed, etc., for greater distinctiveness. When the front cover sheet 15 is in its operating position, the matter on the inside back panel is aligned with and visible through the event windows 16 and the event-decision windows 18. This matter includes both solid, color-coded matter and patterned, color-coded matter to match and connect the paths across the windows 16 and 18. This matter constitutes a visual event indicator 19 to be seen through the event windows 16 and a result indicator 20 when seen through the event-decision window 18. The result indicators 20 also include written instructions such as "GO TO PROCEDURE 1" seen in FIG. 1**.

As seen on the front cover sheet 15 in FIG. 1, there are three parameter windows 21 arranged across its upper front portion. Alongside each of these windows are printed values or conditions 22 for each respective parameter. The parameters in this case are related to nuclear power generation plant operations and include (1) the temperature of core exit thermocouples, (2) the ON or OFF state of some reactor coolant pumps, and (3) the level of coolant in the reactor vessel. These parameters make up the "NOT SUBCOOLED" core cooling inventory which is the topic of this particular computer 10. A typical operating pressure for a reactor vessel in a nuclear power plant is 2250 psi. At this pressure the boiling point of the coolant surrounding the reactor core is about 650 degrees F. When the temperature of the reactor coolant, as measured by the core exit thermocouples is less than 650 degrees F. the reactor is "subcooled". Above the boiling point the reactor coolant is not subcooled, and it is under this condition that this computer 10 is applicable. Other computers can be made according to the invention to relate parameters for (1) subcriticality (a condition where the nuclear reaction is not self-sustaining), (2) the pressure at certain locations in the cooling system, (3) the operation of the heat removal system, and (4) the conditions inside the containment vessel. It will be apparent from the description herein that the principles of the invention can also be applied to a wide variety of process control applications in other industries.

Referring again to the parameter information on the front cover sheet 15 in FIG. 1 for the "NOT SUBCOOLED" core cooling inventory, the three conditions 22 for the temperature of the core exit thermocouples are ABOVE 1200 degrees F., ABOVE 700 degrees F., and BELOW 700 degrees F. The two possible conditions 22 for the reactor coolant pumps are ON and OFF. There are several reactor coolant pumps, and if any pump is on, the condition ON is selected. The conditions 22 for the third parameter, the level of coolant in the reactor vessel are ABOVE 100%, ABOVE 10%, and BELOW 10%. It should be noted that the conditions 22 for the core exit thermocouples and the vessel level are actually limits for an operating range. Thus if the temperature measured at the core exit thermocouples is below 1200 degrees F. it may be either above or below 700 degrees F. The event windows 16 labeled "ABOVE 700 degrees F." and "BELOW 700 degrees F." are used to distinguish the two possible conditions below 1200 degrees F.

When the visual indicators 19 on the inside back panel 13 of the envelope 11 are viewed through the event windows 16 in the front cover sheet 15, the conditions 22 of the parameters are verified through the event windows 16. Besides verification, however, these conditions are also related in an event network leading to logically computed decisions. The concept of the invention is to provide plant operating personnel with an indication of parameter selection which is separated from the event network for easier viewing as well as providing a relationship of these events to decision results through the network.

As illustrated in FIG. 3 three slidable sheet members 23, 24 and 25 each have a pull tab 26 found along an upper edge and their corresponding parameters are indicated thereon. Each parameter slide 23–25 has a parameter indicator mark 27, in this case a horizontal double arrow, aligned within a respective parameter window 21, as seen in FIG. 1, when one end of the parameter slides 23–25 is inserted into its envelope pocket. As seen best in FIG. 3, the parameter indicators 27 are disposed on portions of their respective parameter slides 23–25 that are reduced in width from a lower body portion so as not to block the parameter indicators 27 on the other parameter slides 23–25. Each parameter slide 23–25 also contains logic windows 28 in its lower body portion that are laterally spaced for alignment with the respective tiers of the event network when the slide 23–25 is inserted into the envelope 11. The parameter slides 23–25 are slidably adjusted by gripping the tabs 26 mentioned above.

One set of possible conditions is illustrated in FIG. 1, where the parameter slide 23 corresponding to temperature is positioned with its indicator 27 opposite the condition "ABOVE 700 degrees F." The indicator 27 on the parameter slide 24 corresponding to the state of the reactor coolant pumps is positioned opposite the OFF state. And, the indicator 27 on the parameter slide 25 corresponding to the vessel level is positioned opposite the condition "ABOVE 10%".

It will also be observed in FIG. 1 that there are four tiers of event windows 16 from left to right and one tier of event-decision windows 18. The parameter slides 23–25 have been positioned so that logic windows 28 in each slide 23–25 have been aligned with the following event windows: "NOT SUBCOOLED," "BELOW 1200 DEGREES F.," "PUMPS OFF," "ABOVE 700 DEGREES F.," and "BELOW 100% LEVEL." Caution is indicated through the first three event windows 16, extra caution is indicated through the fourth event window 16 and a warning and a procedure are the result seen through the last window 18. The parameter windows 21, event windows 16 and event-decision windows 18, in their simplest form, are merely apertures, however, these apertures could be covered with transparent material to form solid windows as well, and in this example the transparent cover sheet 12 covers each window 16, 18 and 21.

The logic windows 28 in the intermediate sliding members 23–25 in FIG. 3 can be considered as inputs to a logic function of the type first explained by the British mathematician George Boole. The most common of these functions are the AND and OR functions. In these functions each condition or input is limited to one of two states which shall be designated "true" or "false" for this explanation. Similarly each output is limited to one of two possible states, "true" or "false." In an AND function the output is "true" only if all inputs are "true." Any "false" input results in a "false" output. In an OR function, any "true" input results in a "true" output. Only when all inputs are "false" is the result "false."

In the present device, the logic windows 28 correspond to "true" inputs and the solid portions of each parameter slide 23–25 correspond to "false" inputs. Referring to FIG. 3, the leftmost logic window 28 in each slide 23–25 is large enough so that it is positioned beneath the "NOT SUBCOOLED" event window 16 in FIG. 1 for any position of its parameter indicator 27. Thus, it is always true that the "NOT SUBCOOLED" condition is present. If it is not present, as decided by the operator, the fixed green path indicates the entire calculator 10 is not applicable.

When it is said above that an open logic window 28 indicates a true input this is used only in a mathematical sense. Thus, if an open logic window in the temperature parameter slide 23 is positioned under an event window for "PUMPS ON" or "PUMPS OFF" this is not to say that the condition of "PUMPS ON" is being verified through the position of the temperature slide 23. By providing an open logic window 28, the temperature slide 23 allows the pumps slide 24 to control the truth or falsity of the condition "PUMPS ON." If the parameter indicator is positioned at "PUMPS OFF", as in FIG. 1 a portion of the pumps slide 24 is blocking observation of the event indicator 19 through the event window 16 labeled "PUMPS ON", but the logic windows 28 in the other slides 23 and 25 are open or passive or "always true."

An example of a logic result is also shown in FIG. 1. There are six vessel level windows 18 in the rightmost tier that also indicate results. As a result of the pumps being off, open logic windows 28 in the pumps slide 24 would be positioned underneath the third through the sixth result windows 18. As a result of the parameter indicator 27 being set for a temperature above 700 degrees F., the third and fourth result windows would be blocked by the temperature slide 23 but open logic windows 28 would be positioned underneath the fifth and sixth vessel level windows 18. This allows the position of the vessel level slide 25 to control which of these last two windows 18 will open through all three slides 23–25 to permit viewing of a result indicator 20. As seen in FIG. 1, it is the sixth window that is completely open for the selected position of the vessel level slide 26. This is the equivalent of relating three particular inputs to a result that is logically consistent with these inputs.

FIGS. 4 and 5 show a second embodiment of the invention in which a front cover **15*a* and the back panel 13*a* are fastened together to form an envelope, making a separate envelope unnecessary. Parameter cards 23*a*–25*a* all fit in a single pocket between members 15*a* and 13*a* as seen in FIG. 5. The members 15*a* and 13*a* parameter cards 23*a*–25*a* are made of paperboard rather than plastic. Other materials could also be used for the slides 23*a* –25*a*, so long as slides of these materials are stiff enough to be pushed into the envelope pocket. The windows 16 in the front cover 15*a* are all of the event type. Results or decisions are indicated by matter printed on the front cover 15*a* and connected to the windows 16*a* in the rightmost tier. Aside from these differences, this embodiment has the structure and function of the embodiment seen in FIGS. 1–3**.

A simple method of making the computer 10 is to position each parameter slide 23–25 or **23*a*–25*a* between the cover sheet 15 and 15*a* and the back panel 13** and 13*a*. In making the device, the event windows 16 and 16*a* in the cover member 15 and 15*a* should be open so that a pencil can be used to trace the outline of the event window 16 and 16*a* onto the parameter slide positioned underneath, to mark the locations for the logic windows 28. The parameter slide is then moved to the next position corresponding to a different parameter condition and the procedure is carried out again. After the parameter indicator 27 has been positioned in all of the possible positions, the parameter slide 23–25 and 23*a*–25*a* can be removed and apertures can be cut in the shapes that have been traced on the card.

In carrying out this procedure, certain relationships are observed. The parameter window 21 and the event windows 16 and 16*a* have the same width. The height of the logic window which is necessary to keep the event windows 16 and 16*a* open for all possible positions of the slide is the same as the height of the parameter window 21. The height of each parameter window 21 is approximately three times that of the event windows 16, so the logic window 28 on the parameter slide should also be three times that vertical height to remain open. Where there are numerous branches such as in the tier of event-decision windows 18, the decision windows 18 must be spaced apart far enough so that an open logic window 28 for one does not overlap another decision window 18 when the slide is moved. In other words, for a three-position parameter, the distance between the event-decision windows 18 should be at least twice the height of any one of the decision windows 18, unless an overlapping logic window is desired.

The embodiments and methodology described can be used to provide a small hand-held graphical computer to assist operating personnel in monitoring many types of industrial processes. There will no doubt occur to those skilled in this technical art, various modifications that can be made to the basic embodiments described herein. To distinguish between that which has been described by way of example and that which is basic, the invention has been defined in the following claims.

I claim:

1. A graphical logic computer for displaying conditions for parameters in an event network together with results determined by the logic formed in the structure of the computer members, the computer comprising:

front and back stationary members coupled together, the front stationary member having a plurality of parameter windows in one portion and having a set of event windows connected by graphic paths in another portion, the back stationary member having event indicator means aligned with the event windows, and the front and back stationary members also having means for displaying results at the ends of the graphic paths to relate events to results; and at least two slidable members disposed in between the front and back stationary members, each slidable member having parameter indicator means for alignment within a respective parameter window and for movement between first and second positions in such window to select corresponding first and second conditions for its associated parameter, each slidable member also having logic windows for alignment with selected event windows in the front stationary member to permit observation of event indicator means for events which are connected in at least one graphic path to a displayed result, wherein each slidable member is adapted to be interposed between the event windows and the event indicator means for other events in a second graphic path to obscure visibility of the event indicator means leading to a different result, whereby the selected positions of the respective slidable members display the selected parameter conditions apart from the event network and the result.

2. The graphical logic computer of claim 1, wherein: each position of one of the parameter indicator means corresponds to a limit for a range of values, wherein the slidable member with this position indicator means has a logic window of a size larger than one of the event windows and alignable therewith as the position indicator is moved between two limit positions which both correspond to the defined event, and wherein the slidable member contains another logic window alignable with a second event window for one of the selected limits to distinguish the two positions for the parameter indicator.

3. The graphical logic computer of claim 1, wherein the front and back stationary members are fastened together.

4. The graphical logic computer of claim 1, wherein the back stationary member is part of an envelope having a front transparent portion, and wherein the front stationary member is a separate sheet inserted into the envelope and visible through the transparent front portion of the envelope.

5. The graphical logic computer of claim 1, wherein the results are displayed on the front stationary member and graphically connected to the event windows.

6. The graphical logic computer of claim 1, wherein the event indicator means are color-coded.

7. The graphical logic computer of claim 1, wherein the means for displaying results includes color-coded symbols disposed on the back stationary member and visible through result windows in the front stationary member.

8. The graphical logic computer of claim 1, wherein the graphical paths are coded to distinguish between types of graphical paths.

9. The graphical logic computer of claim 1, wherein a third slidable member has a third parameter indicator means and wherein three parameters are graphically connected through the network of the event windows to a plurality of results.

* * * * *